US010542816B1

(12) United States Patent
Newton

(10) Patent No.: US 10,542,816 B1
(45) Date of Patent: Jan. 28, 2020

(54) GEAR AND DEVICE HOLDING HARNESS SYSTEM

(71) Applicant: Caleb J. Newton, Saratoga, WY (US)

(72) Inventor: Caleb J. Newton, Saratoga, WY (US)

( * ) Notice: Subject to any disclaimer, the term of this patent is extended or adjusted under 35 U.S.C. 154(b) by 0 days.

(21) Appl. No.: 15/942,752

(22) Filed: Apr. 2, 2018

Related U.S. Application Data

(60) Provisional application No. 62/480,935, filed on Apr. 3, 2017.

(51) Int. Cl.
*A45F 3/14* (2006.01)
*A45F 3/04* (2006.01)
*A45F 3/02* (2006.01)

(52) U.S. Cl.
CPC ..... *A45F 3/14* (2013.01); *A45F 3/047* (2013.01); *A45F 2003/045* (2013.01); *A45F 2003/142* (2013.01); *A45F 2003/146* (2013.01)

(58) Field of Classification Search
CPC .... A45F 3/14; A45F 3/047; A45F 3/04; A45F 2003/045; A45F 2200/0516; A45C 2011/002
USPC ..... 224/259
See application file for complete search history.

(56) References Cited

U.S. PATENT DOCUMENTS 2,643,803 A * 6/1953 Bates ..... A45F 5/00 119/857
2,676,738 A * 4/1954 Herrick ..... A45F 3/14 224/249
2,688,752 A * 9/1954 Sbarra ..... A41B 9/00 2/113
2,835,896 A * 5/1958 Giese ..... A41D 13/081 2/66
3,051,130 A * 8/1962 Morris ..... A45F 5/02 224/183
3,089,143 A * 5/1963 Jacobson ..... A62B 35/0006 116/28 R
3,813,017 A * 5/1974 Pimsleur ..... A45C 11/38 224/240
3,972,238 A * 8/1976 Thatcher ..... A61B 5/224 482/128
4,573,573 A * 3/1986 Favaro ..... H04R 1/021 206/216
4,620,653 A * 11/1986 Farrell ..... A41F 9/002 224/219
4,630,763 A * 12/1986 Friedman ..... G10G 5/005 224/259
5,148,804 A * 9/1992 Hill ..... A61F 7/10 607/108
5,323,942 A * 6/1994 Dahan ..... A45C 11/38 224/639

(Continued)

*Primary Examiner* — Nathan J Newhouse
*Assistant Examiner* — Lester L Vanterpool
(74) *Attorney, Agent, or Firm* — Richard Eldredge

(57) ABSTRACT

A gear carrying system for wearing on the body of the user, the gear carrying system includes a body piece to be secured to a front of the user, the body piece having a first pocket having a magnetic closure; and an adjustable pocket; a harness system, having adjustable shoulder straps attached to the body piece; and an adjustable waist strap connected to the adjustable shoulder straps and to extend around the waist of the user; the magnetic closure reduces sound associated with opening the first pocket; and the harness system is to secure the body piece to the front of the user, thereby placing the body piece in a convenient position.

5 Claims, 10 Drawing Sheets

(56) References Cited

U.S. PATENT DOCUMENTS

| | | | | |
|---|---|---|---|---|
| 5,619,955 | A * | 4/1997 | Nelson | A41F 9/005 119/857 |
| 5,692,661 | A * | 12/1997 | Kellerman | A45F 5/00 224/646 |
| 6,182,878 | B1 * | 2/2001 | Racca | A45C 15/00 224/236 |
| 6,790,201 | B2 * | 9/2004 | Meyer | A61M 25/02 224/257 |
| 7,020,897 | B2 * | 4/2006 | Johnson | F41H 1/02 2/102 |
| 9,210,976 | B2 * | 12/2015 | Maeda | A45C 7/0054 |
| 9,923,590 | B1 * | 3/2018 | Picking | H04B 1/385 |
| 2004/0140335 | A1 * | 7/2004 | Hancock | A45F 3/14 224/637 |
| 2009/0084245 | A1 * | 4/2009 | Harbaugh | G10G 5/005 84/327 |
| 2013/0232672 | A1 * | 9/2013 | Reischl | A62B 17/00 2/455 |
| 2014/0151424 | A1 * | 6/2014 | Hexels | A45F 3/06 224/637 |
| 2014/0239032 | A1 * | 8/2014 | Vitangcol | A45F 3/04 224/645 |

* cited by examiner

GEAR AND DEVICE HOLDING HARNESS SYSTEM

BACKGROUND

1. Field of the Invention

The present invention relates generally to containers for carrying items, and more specifically, to a bag worn on the body for carrying items system for use while walking or hiking.

2. Description of Related Art

Containers for carrying items are well known in the art and are effective means to carry items while walking or hiking and keeping one's hand free. For example, FIG. 1 depicts a conventional bag worn on the body for carrying items system 101 having a waist strap 103, a buckle 105 to secure the system 101 around the body, a pouch 109 for carrying items, and a zipper assembly 107 for securing the items in the bag. To use, the user will strap the system 101 on by putting the system 101 around the user's waist with the waist strap 103 and then securing it with the buckle 105. The user will then put the items that cannot fit in the user pocket in the pouch 109 and secure the pouch with the zipper assembly. The system 101 will allow the user to keep their hand's free to do other things while walking and hiking.

One of the problems commonly associated with system 101 is that it does not hold enough, however the user does not have the need for a backpack which is too large and cumbersome. For example, when taking walks or hiking many people bring a camera, binocular, GPS/Range Finders, etc. with them, all of which do not fit well in pockets and can be damage if dropped. Also during walks and hiking trips it is quite common for a person to take electronic devices to stay in contact with their family and work. These devices, cell phones, tablets, etc., do not fit well in pockets and can be damage if not properly handled. System 101 is not designed to hold and protect all the equipment that people bring a walking or hiking trips, and yet a backpack is too large and cumbersome, lacking the compartmentalization for easy access needed during a short walking or hiking trip.

Accordingly, although great strides have been made in the area of bags worn on the body for carrying items systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
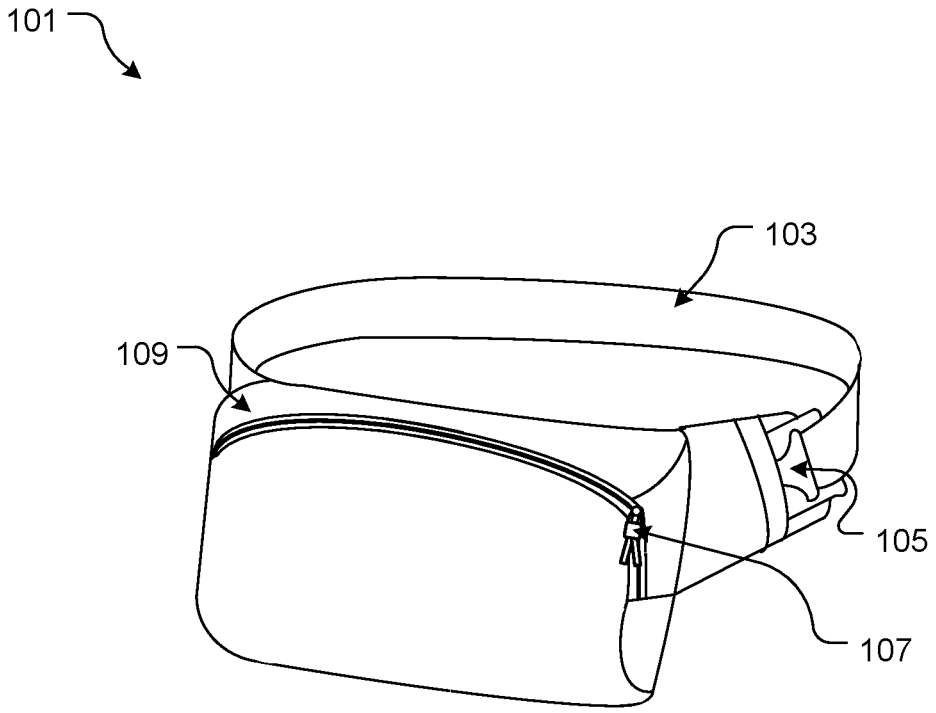
FIG. 1 (Prior Art)
FIG. 1 is a perspective view of a common bag worn on the body for carrying items system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional containers for carrier item. Specifically, the gear and device holding harness system made from durable materials which is designed with a multiplicity of pockets that are held closed with strong magnets that quickly and quietly open and close as to not disturb wild life during the user's walk or hike. The pockets range in size and functions and are designed to hold a variety of items that would be commonly used during a walking, hiking, or other outdoor expedition. Because the pockets vary in size and are specifically designed to be adjustable in size to accommodate a range of different sized equipment the user is not limited to one size of equipment. In the preferred embodiment, the largest pocket is specifically designed to hold binoculars ranging from 8×42 to 15×52 and attached to the large pocket is a smaller pocket for miscellaneous items. The medium sized pocked which can accommodate a variety of different range finders, GPS units or camera. Finally, there is an electronic device, phone, small tablet, etc., pocket that sits on the back side of the pack and protects the electronic device. For extra security and protection against accidentally being dropped, the large and medium sized pockets have access to coil tethered with swivel style hooks attached to two double bar D-Rings that in turn can be attached to the items stored in the large and medium sized pockets. It should be noted that the user can use the pockets for other equipment not mentioned. The gear and device holding harness system is secured to the body with two shoulder straps that cross in the back around an elastic waist band. The waistband adjusts using two tri-glide's to fit all body types and keeps the pack from flopping around during use. There is an optional handwarmer with a very large pocket that can be attached to the bottom of the pack for use during cold weather by the way of a hook and loop material. As each piece of major equipment has a designated pocket, the gear and device holding harness system is easy for the user to quickly retrieve and use equipment as needed without rummaging through a back-pack or waist pack to find the equipment. The user's hands are free from having to carry equipment and the user does not have to fear that the equipment will be inadvertently damage. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
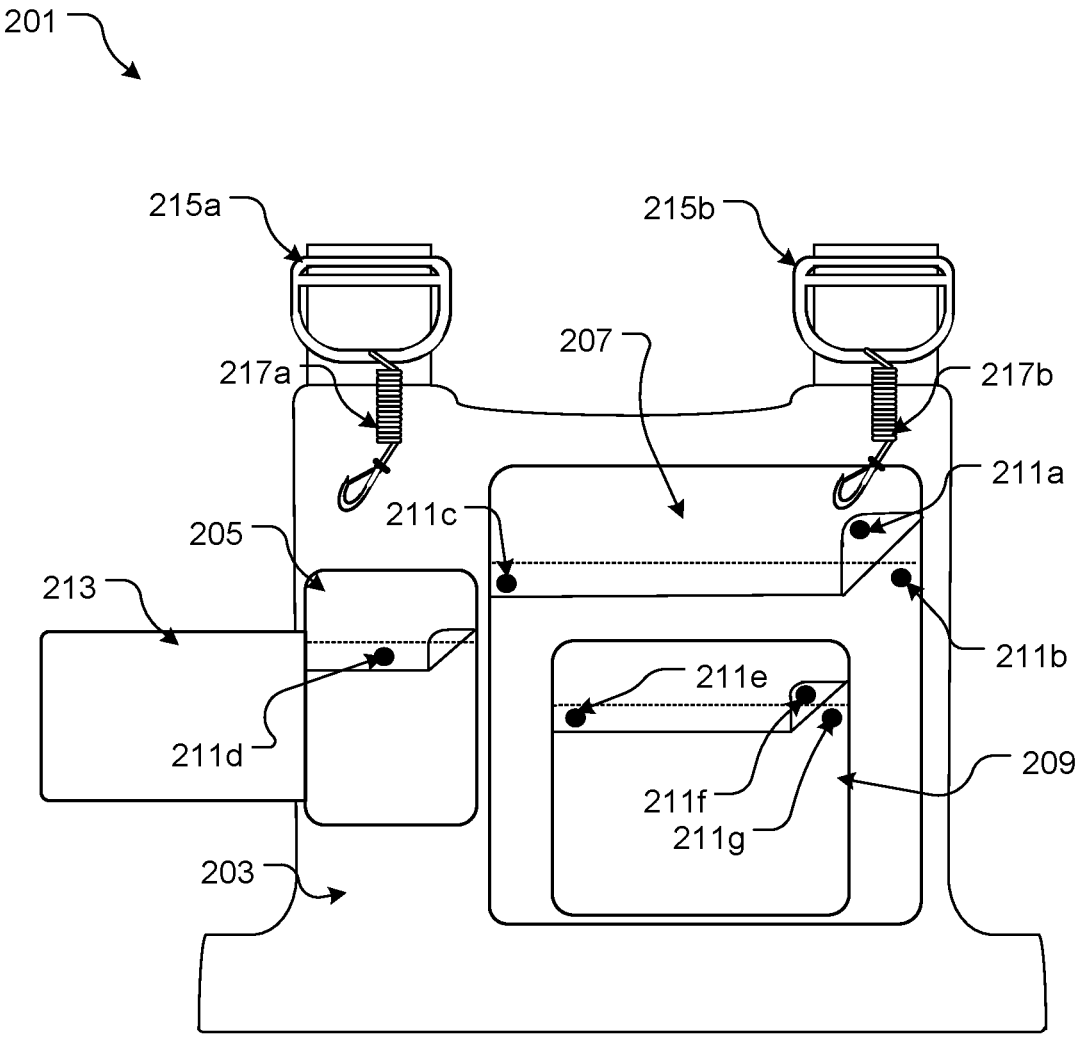
FIG. 2 is an orthogonal front view of a gear and device holding harness system in accordance with a preferred embodiment of the present application.
Figure 3:
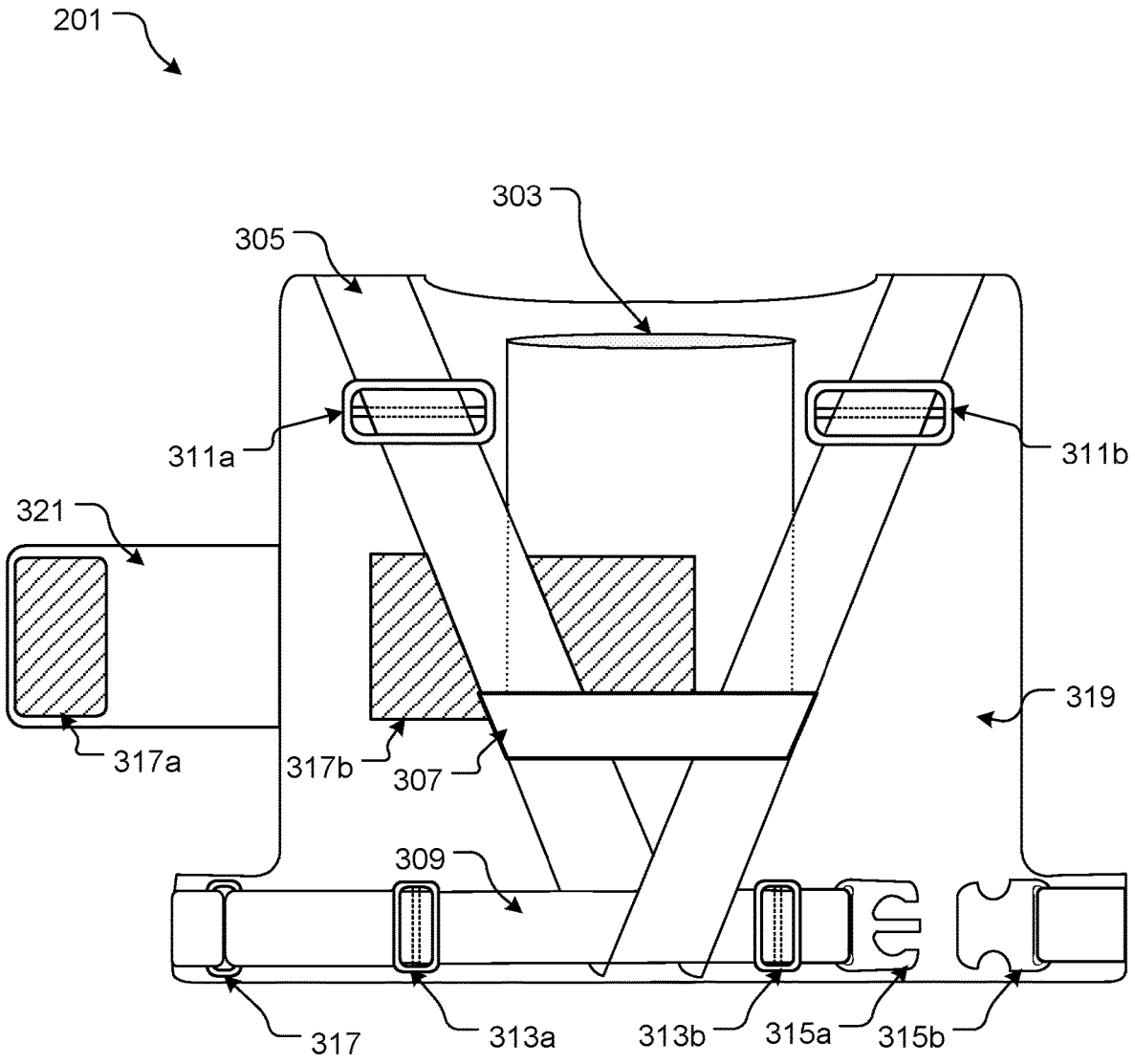
FIG. 3 is an orthogonal back view of the gear and device holding harness system in accordance with the preferred embodiment of the present application.

Referring now to the drawings wherein like reference characters identify corresponding or similar elements throughout the several views, FIG. 2 depicts an orthogonal front view and FIG. 3 depicts an orthogonal back view of a gear and device holding harness system 201 in accordance with a preferred embodiment of the present application. It will be appreciated that system 201 overcomes one or more of the above-listed problems commonly associated with conventional bag worn on the body for carrying items systems.

In the contemplated embodiment, system 201 includes a body piece 203, a reverse side of body piece 319, and a harness piece 301.

In the preferred embodiment and as seen in FIGS. 2, 3, 4A, 5A, and 5B, the body piece 209 comprises a large pocket 207 which can be used to hold binoculars, attached to the large pocket 207 is a miscellaneous pocket 209, and off to one side of the large pocket 207 is an adjustable pocket 205 which can be used to hold items such as a range finder, gps, camera, etc. These pockets 207, 209, and 205 and closed with magnets 211*a*, 211*b*, 211*c*, 211*d*, 211*e*, 211*f* however, it should be appreciated that any quiet quick release and close securing system would be acceptable. The adjustable pocket 205 is made adjustable by elastic webbing 213 which has a hook and loop system 317*a*, 317*b* on a reverse side of elastic webbing 321 and a reverse side of body piece 319. There is another pocket 303 located on the reverse side of body piece 319. A strip hook and loop system 403 is available for the attachment of an attachable handwarmer 401.

Figure 5A:
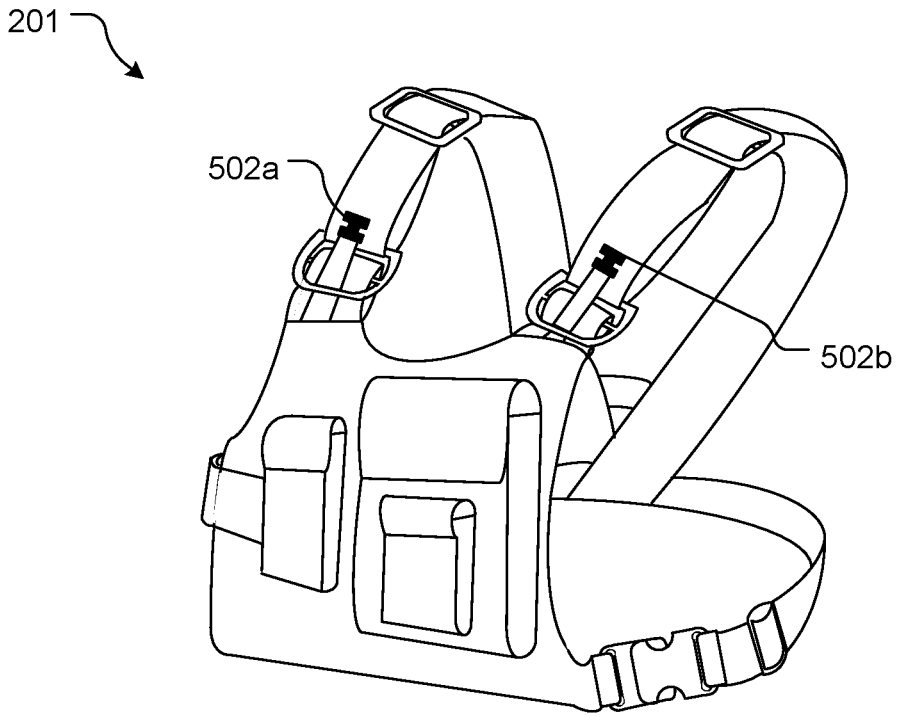
FIGS. 5A and 5B are perspective front views of the gear and device holding harness system in accordance with the preferred embodiment of the present application.
Figure 5B:
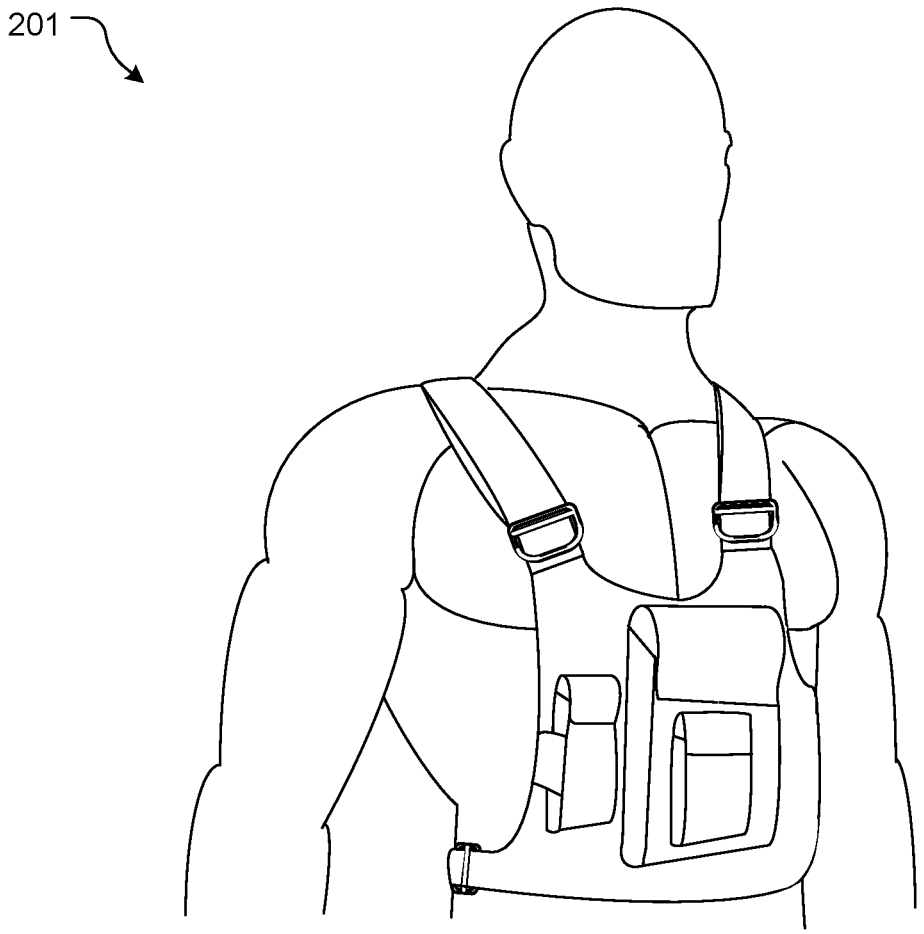

In some embodiments, as shown in FIG. 5A, side releases 502*a*, 502*b* can be connected to the body piece or the shoulder straps, thereby allowing for easy attachment to other equipment, such as day packs. It should be appreciated that this feature is not shown in other figures, but can be included or eliminated from any of the embodiments shown or described throughout.

Figure 4A:
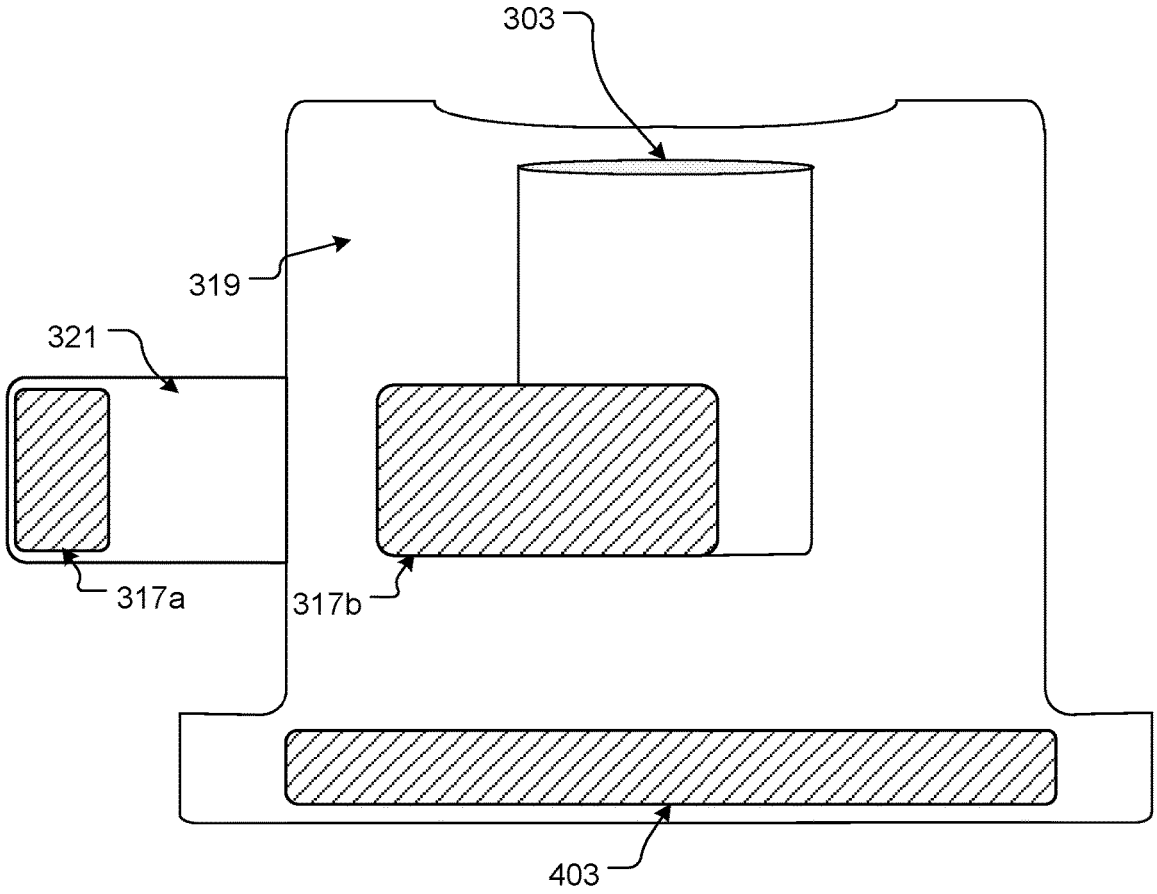
FIG. 4A is an orthogonal back view of the gear and device holding harness system without the harness attached in accordance with the preferred embodiment of the present application.
Figure 4B:
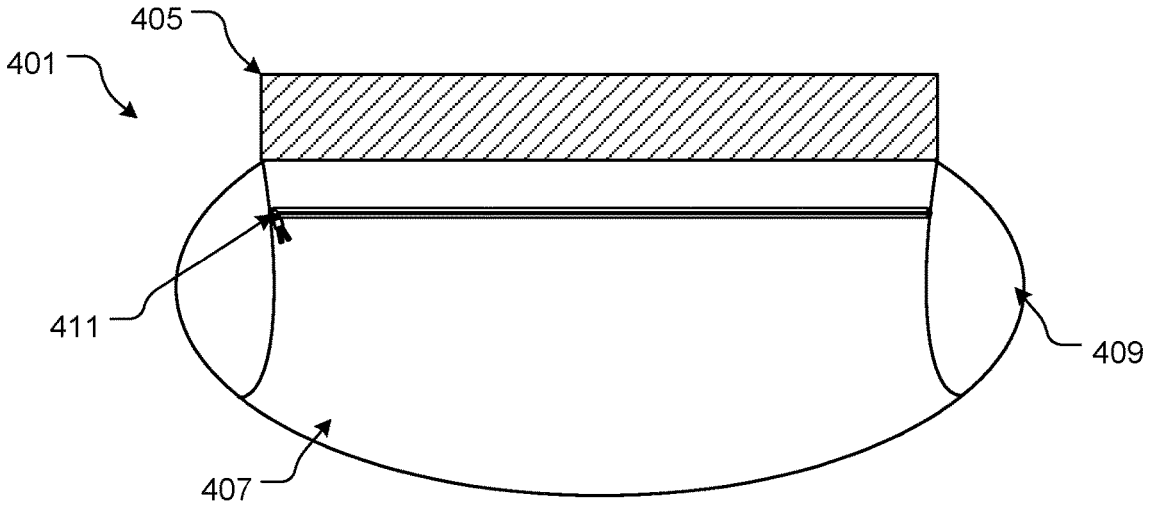
FIG. 4B is an orthogonal front view of an attachable handwarmer for the gear and device holding harness system.

Now referring to FIGS. 4A and 4B respectively an orthogonal back view of the gear and device holding harness system 201 without the harness attached and an orthogonal front view of an attachable handwarmer 401 for the gear and device holding harness system 201 in accordance with the preferred embodiment of the present application. The attachable handwarmer 401 connects to the reverse side of the body piece 319 via a hook and loop system 403, 405. The attachable handwarmer comprises the front of the hand warmer which has a pocket 409 for storing a heating unit. It should be appreciated that the inside of the pocket 409 can be lined with a heat retaining material, either natural material or manmade, to help retain the user's hands warm even without the addition of a heating unit. The pocket 409 is secured with a zipper assembly 411 and there are holes 411 on either ends of the attachable handwarmer 401 for insertion of the user's hands.

Figure 6A:
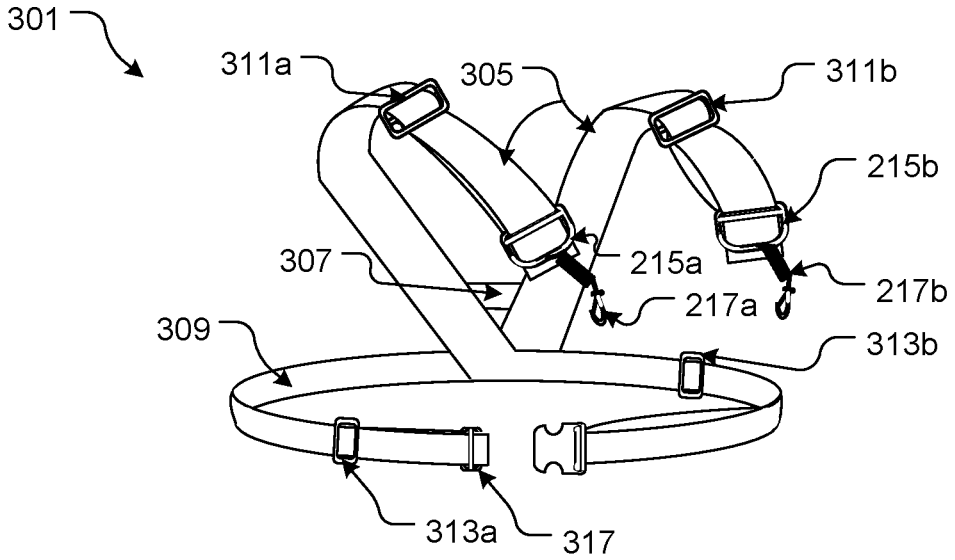
FIG. 6A is perspective view of a harness for the gear and device holding harness system in accordance with the preferred embodiment of the present application.
Figure 6B:
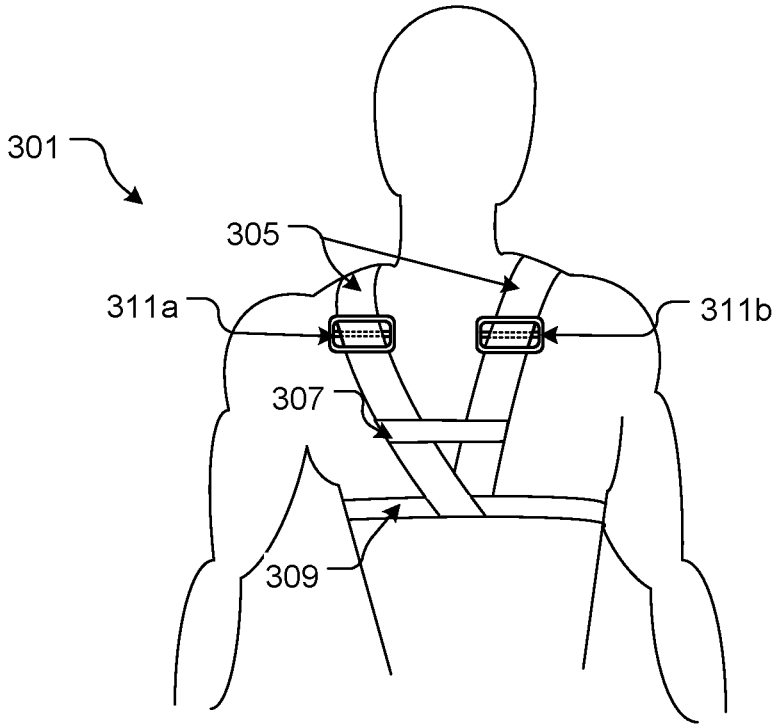
FIG. 6B is perspective back view of the gear and device holding harness system being worn in accordance with the preferred embodiment of the present application.

Now referring to FIGS. 3, 6A and 6B respectively an orthogonal back view, a perspective view of the harness, and a perspective back view of the gear and device holding harness system being worn in accordance with a preferred embodiment of the present application. The harness piece 301 comprises of shoulder straps 305 double bar d-rings 215*a*, 215*b* which connect to coil tethers 217*a*, 217*b*. The coil tethers 217*a*, 217*b* can be used to secure the items that are stored in the large pocket 207 and the adjustable pocket 205. The shoulder straps 305 are adjustable using slide stops 311*a*, 311*b* to fit the user and the shoulder straps 305 are held securely in position by a retraining strap 307. The shoulder straps 305 loop around a waist strap 309, which in the preferred embodiment comprises of an elastic type material, but it should be appreciated that other types of materials can be used. The length of the waist strap 309 is adjustable using slide stops 313*a*, 313*b* to fit the user. A loop connector 317 connects the body piece 203/319 to the waist strap 309 of the harness piece 301. A receiving end of a buckle 315*b* connects the body piece 203/319 to a joining end buckle 315*a* that is in turn connected to the waist strap 309 of the harness piece 301. The waist strap 309 is adjustable between two slide stops 313*a*, 313*b* to custom fit the user's waist.

Figure 7:
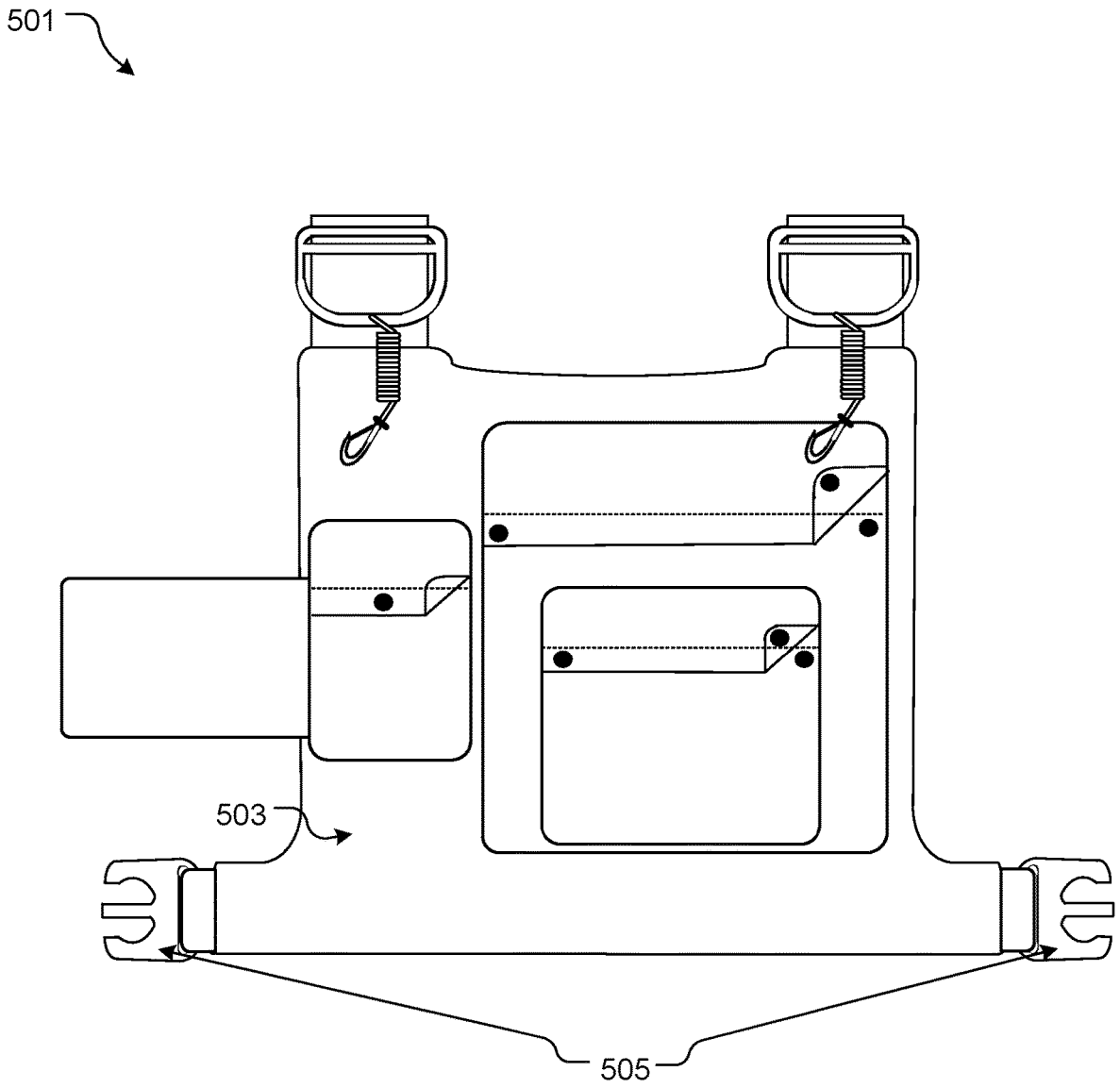
FIG. 7 is an orthogonal front view of a gear and device holding harness system in accordance with an alternative embodiment of the present application.
Figure 8:
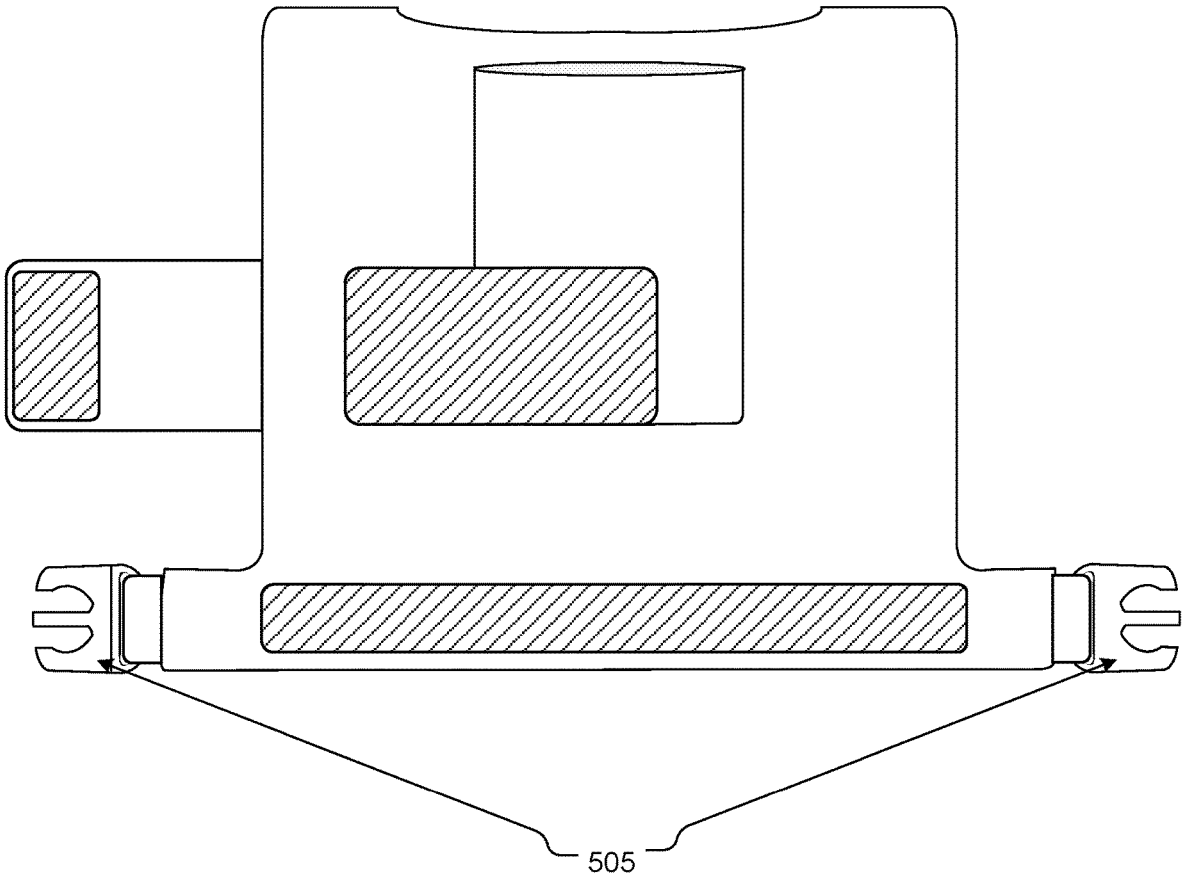
FIG. 8 is an orthogonal back view of the gear and device holding harness system without the harness attached in accordance with the alternative embodiment of the present application.
Figure 9:
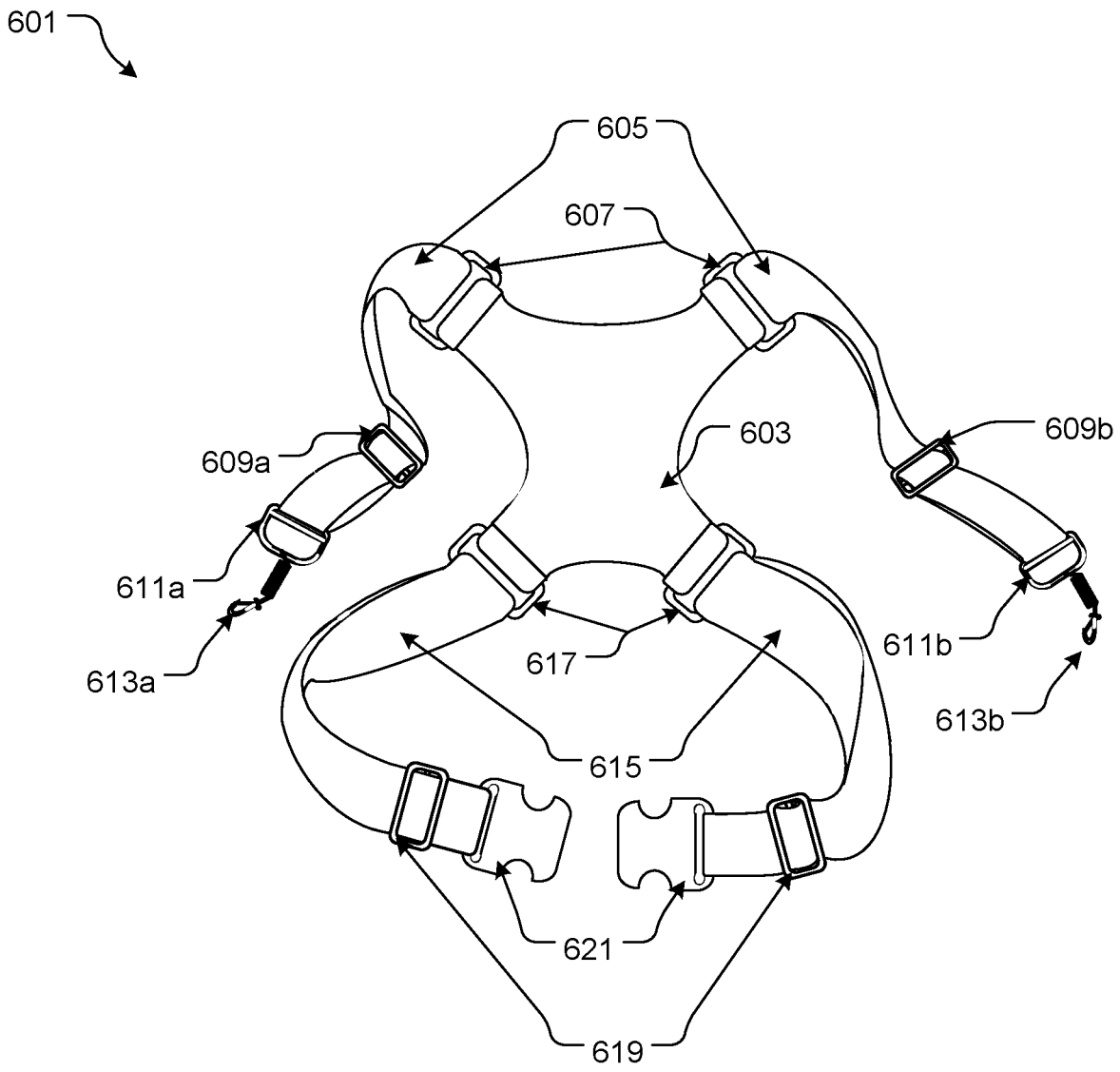
FIG. 9 is a perspective view of a shoulder and waist strap harness for the gear and device holding harness system in accordance of the alternative embodiment.

Referring now to an alternative embodiment FIGS. 7, 8, and 9 respectively an orthogonal front view of a gear and device holding harness system 501, an orthogonal back view of the gear and device holding harness system 501 without the harness attached, and a perspective view of a shoulder and waist strap harness for a gear and device holding harness system 501 in accordance with an alternative embodiment. Is should be appreciated that the alternative gear and device holding harness system 501 is basically the same as the preferred embodiment of the gear and device harness system 201 with some changes. The major changes will be discussed in the following paragraphs. It should be appreciated that unless mentioned below the other features of the preferred of the gear and device harness system 201 are available in this alternative embodiment.

The alternative gear and device holding harness system 501 differs from the preferred gear and device harness system 201 in that the body piece 503 also comprises two quick release male buckle pieces 505 which are used to attached the body piece 503 to the alternative shoulder and waist harness 601.

The shoulder and waist strap harness 601 comprises of a back-harness piece 603 which is attached to shoulder straps 605 and waist straps 615. Both the shoulder straps 605 and waist straps 615 are connected to the back-harness piece through the utilization of loop connectors 607, 617. Both the shoulder straps 605 and waist straps have tri-glide slides 609*a*, 609*b*, 619 which the user uses to adjust the fit of the straps to conform to the user's body for a custom fit. The shoulder straps end in double bar d-rings 611*a*, 611*b* which connect to coil tethers 613*a*, 613*b* that are used to secure items. The waist straps end in buckle pieces 621 that secure the should waist strap harness 601 into the body piece about the user.

It should be appreciated that one of the unique features believed characteristic of the present application is the ability to carry the equipment necessary for a walking or hiking trip and have it easily accessible while keeping the equipment protected.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A gear carrying system for wearing on the body of the user, the gear carrying system comprising:

a body piece configured to be secured to a front of the user, the body piece having:

a first pocket having a magnetic closure;

an adjustable pocket secured to a front of the body piece, the adjustable pocket having an elastic webbing extending away from a side of the adjustable pocket to allow for adjustment of the adjustable pocket; and a first hook and a loop fastener on a reverse side of the elastic webbing;

a second hook and loop fastener on a reverse side of the body to engage with the first hook and loop fastener;

wherein securing the first hook and loop fastener to the second hook and loop fastener adjusts a width of the adjustable pocket;

a harness system, having:

adjustable shoulder straps attached to the body piece;

an adjustable waist strap connected to the adjustable shoulder straps and configured to extend around the waist of the user; and a retaining strap secured to the shoulder straps and extends in a direction parallel to the adjustable waist strap;

wherein the adjustable straps form a v-shape configuration relative to the adjustable waist strap;

wherein the adjustable straps wrap around the adjustable waist strap;

wherein the magnetic closure reduces sound associated with opening the first pocket; and wherein the harness system is configured to secure the body piece to the front of the user, thereby placing the body piece in a convenient position.

2. The system of claim 1, further comprising:

a hand warmer configured to secure to the body piece.

3. The system of claim 1, wherein the harness system further comprises:

two coil tethers attached to each end of the shoulder straps in a front position of each of the shoulder straps;

the two coil tethers configured to removably attach to gear items carried by the user.

4. The system of claim 1, further comprising:

a side release attached to one of the shoulder straps and configured to engage with a gear item carried by the user.

5. The system of claim 1, wherein the harness system further comprises:

a back piece configured to attach to the adjustable shoulder straps and the adjustable waist strap.

* * * * *